US010953679B2

(12) United States Patent
Arita

(10) Patent No.: US 10,953,679 B2
(45) Date of Patent: Mar. 23, 2021

(54) METHOD FOR MANUFACTURING PRINTED MATTER AND PRINTED MATTER

(71) Applicant: Manabu Arita, Kanagawa (JP)

(72) Inventor: Manabu Arita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/351,820

(22) Filed: Mar. 13, 2019

(65) Prior Publication Data

US 2019/0283478 A1 Sep. 19, 2019

(30) Foreign Application Priority Data

Mar. 19, 2018 (JP) ..... JP2018-051141

(51) Int. Cl.

| | |
|---|---|
| ***B41J 2/01*** | (2006.01) |
| ***B41M 5/00*** | (2006.01) |
| ***B41M 7/00*** | (2006.01) |

(52) U.S. Cl.

CPC ..... *B41M 5/0011* (2013.01); *B41M 7/0081* (2013.01)

(58) Field of Classification Search

None

See application file for complete search history.

(56) References Cited

U.S. PATENT DOCUMENTS

| | | | | |
|---|---|---|---|---|
| 2002/0146543 | A1* | 10/2002 | Hooker | B41M 7/0045 428/195.1 |
| 2005/0201674 | A1* | 9/2005 | Ellwood, Jr. | G02F 1/0115 385/17 |
| 2012/0015110 | A1* | 1/2012 | Tian | C08F 2/48 427/508 |
| 2015/0070451 | A1* | 3/2015 | Ikeda | C09D 11/34 347/102 |
| 2016/0326387 | A1 | 11/2016 | Arita et al. | |
| 2016/0347961 | A1 | 12/2016 | Kobayashi et al. | |
| 2017/0015850 | A1 | 1/2017 | Yoshino et al. | |
| 2017/0058135 | A1 | 3/2017 | Kohzuki et al. | |
| 2017/0165994 | A1* | 6/2017 | Takabayashi | B41J 11/002 |
| 2018/0016455 | A1 | 1/2018 | Kohzuki et al. | |
| 2018/0333909 | A1 | 11/2018 | Arita et al. | |
| 2019/0185696 | A1* | 6/2019 | Nakhmanovich | G03F 7/027 |

FOREIGN PATENT DOCUMENTS

| | | |
|---|---|---|
| JP | 2009-208348 | 9/2009 |
| JP | 2010-188729 | 9/2010 |
| JP | 2012-025912 | 2/2012 |
| WO | WO2004/002746 A1 | 1/2004 |

* cited by examiner

*Primary Examiner* — Matthew Luu
*Assistant Examiner* — Tracey M McMillion
(74) *Attorney, Agent, or Firm* — Oblon, McClelland, Maier & Neustadt, L.L.P.

(57) ABSTRACT

A method for manufacturing printed matter is provided. The method includes the steps of: irradiating applied droplets of an active energy ray curable composition with an active energy ray having an illuminance less than 0.8 times a maximum gloss illuminance; and applying droplets of the active energy ray curable composition onto the applied droplets irradiated in the irradiating.

18 Claims, 6 Drawing Sheets

METHOD FOR MANUFACTURING PRINTED MATTER AND PRINTED MATTER

CROSS-REFERENCE TO RELATED APPLICATIONS

This patent application is based on and claims priority pursuant to 35 U.S.C. § 119(a) to Japanese Patent Application No. 2018-051141, filed on Mar. 19, 2018, in the Japan Patent Office, the entire disclosure of which is incorporated by reference herein.

BACKGROUND

Technical Field

Embodiments of this disclosure relate to a method for manufacturing printed matter and printed matter.

Description of the Related Art

As ultraviolet rays (UV) curable inkjet inks have properties such as substrate compatibility, quick drying property, strength, etc., they have been widely used in decorative printing of various construction materials, daily necessities, and automotive supplies, sign printing of banners and posters, and display printing.

Recently, laminates have been formed by an inkjet method in printing which requires high precision such as the reproduction of an oil painting. For example, not only the color but also irregularities can be reproduced on demand as reproductions such as the thickness of paint of the oil painting, the touch of the brush, and the texture of the canvas. However, other than the patterns and shapes, the on-demand property of texture such as the gloss is low. In UV curable inkjets, as the influence of the penetration and the volatilization of the ink is small, and the impacted ink droplets are cured as is by ultraviolet rays (UV), the surface irregularities tend to depend on the dot shape of inkjet droplets, that is, the wettability of the ink droplets. Therefore, the gloss often depends on the ink type, and is difficult to control on demand. For example, in the reproduction of paintings etc., in order to faithfully reproduce the glossiness of the original image, it is necessary to read the glossiness, and digitally reproduce the glossiness as is.

For solving the problems, generally, a partial decoration can be provided by spot coating with a clear ink, but there are the problems that this method is the selection of the presence or the absence of gloss, the glossiness cannot be freely controlled, and the texture differs greatly.

In attempting to solve this problem, a method for controlling the gloss by adjusting the emission timing of UV light onto the clear ink and controlling the levelling time has been proposed.

Further, an ink formulation in which curing inhibition occurs easily due to oxygen at the surface has been proposed, for liquefying a surface, increasing the wettability of the ink, and exhibiting gloss.

Further, a method for using curing inhibition due to oxygen to change the gloss by partial curing and finishing with an additional irradiation has been proposed.

SUMMARY

In accordance with some embodiments of the present invention, a method for manufacturing printed matter is provided. The method includes the steps of: irradiating applied droplets of an active energy ray curable composition with an active energy ray having an illuminance less than 0.8 times a maximum gloss illuminance; and applying droplets of the active energy ray curable composition onto the applied droplets irradiated in the irradiating.

In accordance with some embodiments of the present invention, another method for manufacturing printed matter is provided. The method includes the steps of: irradiating applied droplets of an active energy ray curable composition with an active energy ray having an illuminance 0.8 to 1.49 times a maximum gloss illuminance; and applying droplets of the active energy ray curable composition onto the applied droplets irradiated in the irradiating.

In accordance with some embodiments of the present invention, another method for manufacturing printed matter is provided. The method includes the steps of: (a) irradiating applied droplets of an active energy ray curable composition with an active energy ray having an illuminance less than 0.8 times a maximum gloss illuminance; (b) irradiating applied droplets of the active energy ray curable composition with an active energy ray having an illuminance 0.8 to 1.49 times the maximum gloss illuminance; and (c) applying droplets of the active energy ray curable composition onto the applied droplets irradiated in the steps (a) and (b).

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
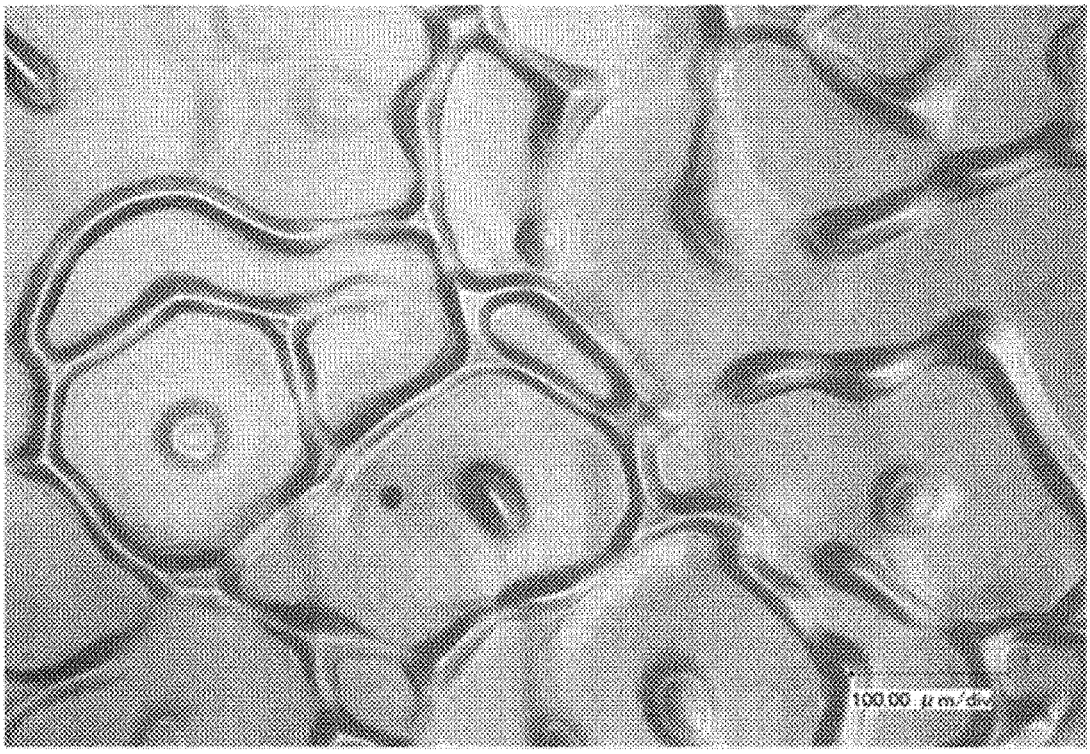
FIG. 1 is an enlarged image of a matte tone printed matter (having pattern-shaped irregularity)

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

According to some embodiments of the present invention, a method for manufacturing printed matter is provided which can control the change of the gloss from a glossy tone to a matte tone to the extent that the change can be recognized.

(Method for Manufacturing Printed Matter and Device for Manufacturing Printed Matter)

The first embodiment of the present invention provides a method for manufacturing printed matter in which the glossiness is variable due to the illuminance of an active energy ray. The method includes a first irradiation process for irradiating applied droplets of an active energy ray curable composition with an active energy ray having an illuminance less than 0.8 times a maximum gloss illuminance, and a first application process for applying droplets of the active energy ray curable composition onto the applied droplets irradiated in the first irradiation process. The method preferably includes a first solidification process, and further includes other processes in accordance with need.

The first embodiment of the present invention provides a device for manufacturing printed matter in which the glossiness is variable due to the illuminance of an active energy ray. The device includes a first irradiator configured to irradiate applied droplets of an active energy ray curable composition with an active energy ray having an illuminance less than 0.8 times the maximum gloss illuminance, and a first applicator configured to apply droplets of the active energy ray curable composition onto the applied droplets irradiated by the first irradiator. The device preferably includes a first solidification device, and further includes other devices in accordance with need.

The second embodiment of the present invention provides a method for manufacturing printed matter in which the glossiness is variable due to the illuminance of an active energy ray. The method includes a second irradiation process for irradiating applied droplets of an active energy ray curable composition with an active energy ray having an illuminance 0.8 to 1.49 times the maximum gloss illuminance, and a second application process for applying droplets of the active energy ray curable composition onto the applied droplets irradiated in the second irradiation process. The method preferably includes a second solidification process, and further includes other processes in accordance with need.

The second embodiment of the present invention provides a device for manufacturing printed matter in which the glossiness is variable due to the illuminance of an active energy ray. The device includes a second irradiator configured to irradiate applied droplets of an active energy ray curable composition with an active energy ray having an illuminance 0.8 to 1.49 times the maximum gloss illuminance, and a second applicator configured to apply droplets of the active energy ray curable composition onto the applied droplets irradiated by the second irradiator. The device preferably includes a second solidification device, and further includes other devices in accordance with need.

The third embodiment of the present invention provides a method for manufacturing printed matter comprising a combination of the method for manufacturing printed matter of the first embodiment and the method for manufacturing printed matter of the second embodiment, and further includes other processes in accordance with need.

The third embodiment of the present invention provides a device for manufacturing printed matter comprising a combination of a device configured to perform the method for manufacturing printed matter of the first embodiment and a device configured to perform the method for manufacturing printed matter of the second embodiment, and further includes other devices in accordance with need.

The devices for manufacturing printed matter and the methods for manufacturing printed matter of the first to third embodiments of the present invention solve the problems of the conventional technologies. For example, the gloss control in the conventional technology uses a clear ink, and thus, the texture is different from the color ink alone. Further, due to the control over time, there are the problems that the gloss control range is also limited due to restrictions on the apparatus and the like, there is an influence by the state and shape of the coated side, and the control accuracy is not sufficient.

As another example, the expression of the gloss in the conventional technology is dependent on the ink formulation, and the glossiness cannot be controlled. Further, the problem of inhibition of curing at the surface remains.

As another example, the conventional technology requires UV irradiation under a low oxygen environment and a change in the wavelength of the UV light source in order to utilize the curing inhibition due to oxygen, and completely cure the material in order to solve the problem of curing failure of the partially cured material. Further, there is the problem that the effect is unclear since the extent of the variation of the gloss and how the gloss vary are unknown.

Therefore, with the conventional technology, it is difficult to control the change of the gloss from a glossy tone to a matte tone to the extent that the change can be recognized, and to obtain the physical properties of a coated film free from curing failure with a simple active energy ray irradiation apparatus.

The surface shape of the printed matter in the present disclosure influences the gloss. The printed matter having a glossy tone preferably has small irregularities derived from the droplets of the active energy ray curable composition. The printed matter with a matte tone preferably has large irregularities on the surface, and the irregularities may be either those derived from the dot shape of the droplets or other pattern-shaped irregularities. When droplets of the active energy ray curable composition impact the cured product with a liquid surface, obtained by being irradiated with an active energy ray having a low illuminance, pattern-shaped irregularities different from the dot shape of the droplets can also be formed.

According to an embodiment of the present invention, the surface curing state of the droplets of the active energy ray curable composition is controlled to be in a solid state or a liquid state, to change the wettability and the shape of other droplets of the active energy ray curable composition impacting on the droplets of the active energy ray curable composition, thereby changing the glossiness of the printed matter to be obtained. Further, to control the curing state of the active energy ray curable composition, a disproportionation curing process is employed in which the polymer obtained by photopolymerization of the active energy ray curable composition is insolubilized, so as to solid-liquid separate the unreacted monomer liquid and the polymer solid after the reaction, thereby emphasizing the difference of the surface curing state and broaden the gloss range and thus, solving the problem of curing failure.

Therefore, the devices for manufacturing printed matter and the methods for manufacturing printed matter of the first to third embodiments of the present invention make it possible to control the change of the gloss from a glossy tone to a matte tone to the extent that the change can be recognized by comprising the first irradiation process for irradiating applied droplets of the active energy ray curable composition with an active energy ray having an illuminance less than 0.8 times the maximum gloss illuminance along with the first application process, and/or the second irradiation process for irradiating applied droplets of the active energy ray curable composition with an active energy ray having an illuminance 0.8 to 1.49 times the maximum gloss illuminance along with the second application process.

(Device for Manufacturing Printed Matter and Method for Manufacturing Printed Matter of the First Embodiment)

The device for manufacturing printed matter and the method for manufacturing printed matter of the first embodiment manufacture a matte tone printed matter with a pattern formation as shown in FIG. 1.

<First Irradiation Process and First Irradiator>

The first irradiation process is a process for irradiating applied droplets of an active energy ray curable composition with an active energy ray having an illuminance less than 0.8 times the maximum gloss illuminance, and is carried out by the first irradiator. A solid-liquid separation structure having a liquid surface is formed by the first irradiation process.

Figure 2:
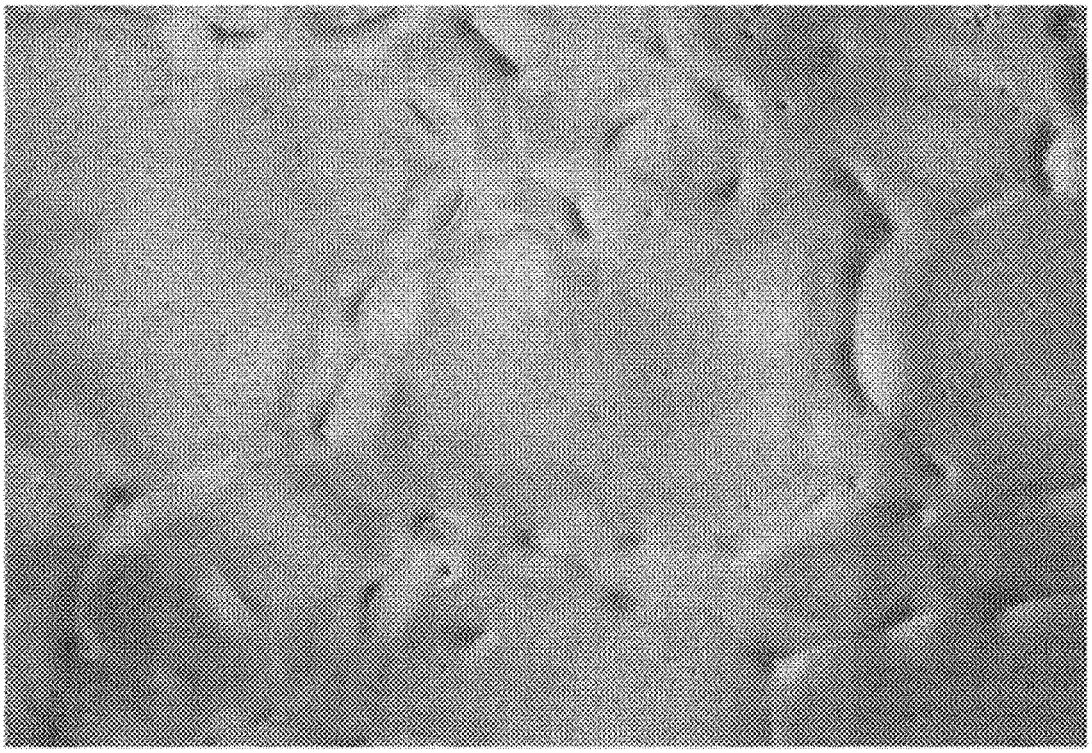
FIG. 2 is an enlarged image of a matte tone printed matter (having pattern-shaped irregularity)

The applied droplets of the active energy ray curable composition are irradiated with an active energy ray having an illuminance less than 0.8 times the maximum gloss illuminance, preferably 0.5 times or less the maximum gloss illuminance. Formation of a pattern tends to start when the illuminance falls below 0.8 times the maximum gloss illuminance, and printed matter as shown in FIG. 2 can be obtained. When the illuminance is 0.5 times or less the maximum gloss illuminance, pattern-shaped irregularities become sufficiently large, so that printed matter as shown in FIG. 1 having a matte tone can be easily obtained. The lower limit may be any value as long as it is within the range at which the interior is cured, and can be appropriately adjusted in accordance with the internal curability depending on the color density and the type and amount of the initiator. Furthermore, it is preferable that the illuminance is at least that by which the interior can be cured to the extent that bleeding and the like does not occur.

The maximum gloss illuminance refers to an illuminance with which the resulting printed matter shows the maximum value of 60-degree glossiness measured by a gloss meter (for example, Microgloss manufactured by BYK Gardener) at intervals of 0.05 $W/cm^2$ between 0.25 $W/cm^2$ and 1.00 $W/cm^2$.

<First Application Process and First Applicator>

The first application process is a process for applying droplets of the active energy ray curable composition onto the applied droplets irradiated in the first irradiation process, and is carried out by the first applicator.

The application of the droplets of the active energy ray curable composition in the first application process is preferably performed by an inkjet method.

<First Solidification Process and First Solidification Device>

The first solidification process is a process for further irradiating the droplets of the active energy ray curable composition applied in the first application process with an active energy ray, to solidify a surface of the printed matter, and is carried out by the first solidification device.

By performing the first solidification process, a solid surface rather than a liquid surface can be formed.

In the first solidification process, preferably, the droplets of the active energy ray curable composition applied in the first application process is irradiated with an active energy ray having an illuminance 1.2 times or more the maximum gloss illuminance.

In the first solidification process, the droplets may be irradiated with an active energy ray having the same illuminance as that in the first irradiation process as a series of processes, and may be cured by the cumulative light due to the light leakage during multi-pass printing. Alternatively, the droplets may also be cured by an active energy ray having an illuminance 1.2 times or more the maximum gloss illuminance as an additional active energy ray irradiation.

Specifically, the method for manufacturing matte tone printed matter (having pattern-shaped irregularities) includes a lower layer formation process for forming a solid-liquid separation structure having a liquid surface as a lower layer, an upper layer formation process for applying droplets of an active energy ray curable composition on the lower layer to form pattern-shaped irregularities as an upper layer, and a solidification process for solidifying the upper layer or a liquid surface layer of the upper layer. At least a part of the upper layer and the lower layer may overlap.

In the lower layer formation process, preferably, the droplets of the active energy ray curable composition are irradiated with an active energy ray having an illuminance less than 0.8 times the maximum gloss illuminance, and more preferably with an active energy ray having an illuminance 0.5 times or less the maximum gloss illuminance. Formation of a pattern tends to start when the illuminance falls below 0.8 times the maximum gloss illuminance, so that printed matter as shown in FIG. 2 can be obtained. When the illuminance is 0.5 times or less the maximum gloss illuminance, pattern-shaped irregularities become sufficiently large, so that printed matter as shown in FIG. 1 having a matte tone can be easily obtained. The lower limit may be any value as long as it is within the range at which the interior is cured, and can be appropriately adjusted in accordance with internal curability depending on the color density and the type and amount of the initiator. Furthermore, it is preferable that the illuminance is at least that by which the interior can be cured to the extent that bleeding and the like does not occur.

The solidification process for solidifying the upper layer is not specifically limited, but is preferably an irradiation process for irradiating the upper layer with an active energy ray. The upper layer can be solidified in a continuous process. By this process, a solid surface rather than a liquid surface is formed. In a curing process for curing the upper layer, the upper layer may be irradiated with an active energy ray having the same illuminance as that in the lower layer formation process as a series of processes, and may be cured by the cumulative light due to light leakage during multi-pass printing. Alternatively, the upper layer may also be cured by an active energy ray having an illuminance 1.2 times or more the maximum gloss illuminance as a separate active energy ray irradiation. Furthermore, it is preferable that the upper layer is irradiated with an active energy ray having an illuminance 1.2 times or more the maximum gloss illuminance without being irradiated with an active energy ray having an illuminance less than 0.8 times the maximum gloss illuminance that is the same as that in the lower layer formation process. The influence of the curing inhibition due to oxygen can be reduced by curing with one active energy ray irradiation, and a sufficient curing reaction proceeds easily.

<Other Processes and Other Devices>

The other processes are not specifically limited. They can suitably be selected to a particular application, and, specific examples include a control process.

The other devices are not specifically limited. They can suitably be selected to a particular application, and specific examples include a controller.

—Control Process and Controller—

The control process is a process for controlling each process, and is preferably performed by the controller.

The controller is not specifically limited as long as the operation of each device can be controlled. It can suitably be selected to a particular application, and specific examples include equipment such as a sequencer or a computer.

(Device for Manufacturing Printed Matter and Method for Manufacturing Printed Matter of the Second Embodiment)

Figure 3:
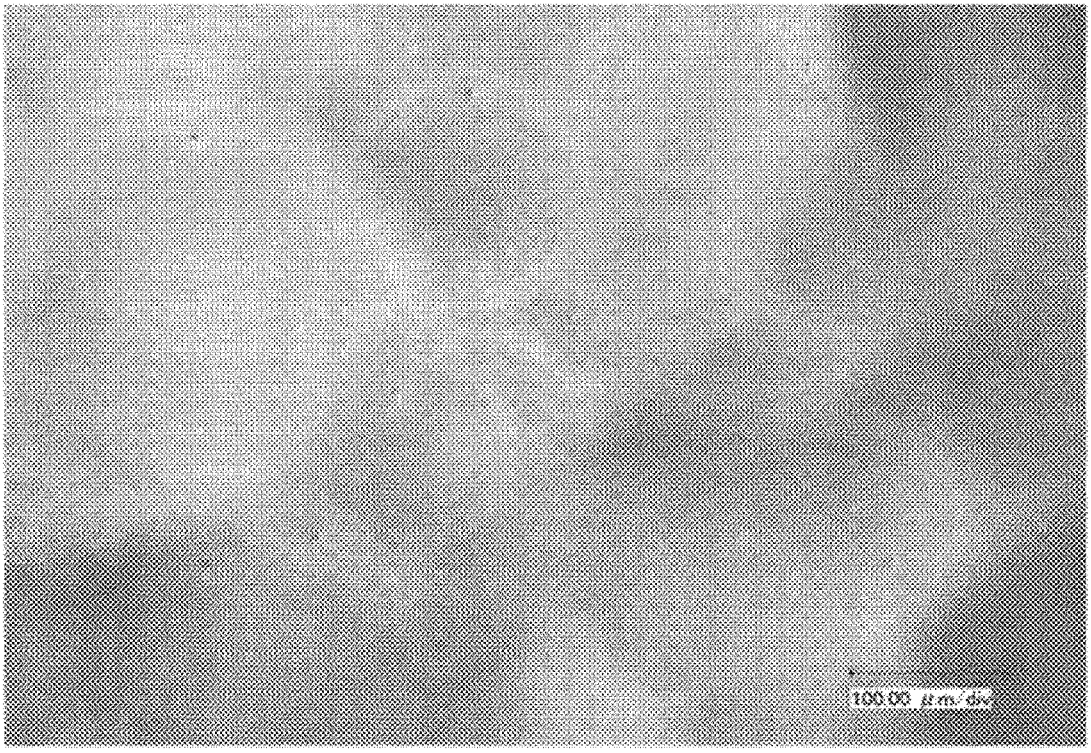
FIG. 3 is an enlarged image of a glossy tone printed matter.

The device for manufacturing printed matter and the method for manufacturing printed matter of the second embodiment manufacture glossy tone printed matter as shown in FIG. 3.

<Second Irradiation Process and Second Irradiator>

The second irradiation process is a process for irradiating applied droplets of an active energy ray curable composition with an active energy ray having an illuminance 0.8 to 1.49 times the maximum gloss illuminance, and is carried out by the second irradiator. A solid-liquid separation structure having a liquid surface is formed by the second irradiation process.

The applied droplets of the active energy ray curable composition are irradiated with an active energy ray having an illuminance 0.8 to 1.49 times the maximum gloss illuminance, preferably 0.9 to 1.2 times the maximum gloss illuminance, and specifically preferable 1 time the maximum gloss illuminance. When the illuminance is 0.8 to 1.49 times the maximum gloss illuminance, glossy tone printed matter as shown in FIG. 3 can be obtained. If the illuminance is less than 0.8 times the maximum gloss illuminance, the formation of pattern-shaped irregularities occurs, and the glossiness decreases. If the illuminance is in excess of 1.49 times the maximum gloss illuminance, the irregularities of the ink droplets become large, and the glossiness decreases.

The maximum gloss illuminance refers to an illuminance with which the resulting printed matter shows the maximum value of 60-degree glossiness measures by a gloss meter (for example, Microgloss manufactured by BYK Gardener) at intervals of 0.05 $W/cm^2$ between 0.25 $W/cm^2$ and 1.00 $W/cm^2$.

<Second Application Process and Second Applicator>

The second application process is a process for applying droplets of the active energy ray curable composition onto the applied droplets irradiated in the second irradiation process, and is carried out by the second applicator.

The application of the droplets of the active energy ray curable composition in the second application process is preferably performed by an inkjet method.

<Second Solidification Process and Second Solidification Device>

The second solidification process is a process for further irradiating the droplets of the active energy ray curable composition applied in the second application process with an active energy ray, to solidify a surface of the printed matter, and is carried out by the second solidification device.

By performing the second solidification process, a solid surface rather than a liquid surface can be formed.

In the second solidification process, preferably, the droplets of the active energy ray curable composition applied in the second application process are irradiated with an active energy ray having an illuminance 1.2 times or more the maximum gloss illuminance.

In the second solidification process, the droplets may be irradiated with an active energy ray having the same illuminance as that in the second irradiation process as a series of processes, and may be cured by the cumulative light due to the light leakage during multi-pass printing. Alternatively, the droplets may also be cured by an active energy ray having an illuminance 1.2 times or more the maximum gloss illuminance as an additional active energy ray irradiation.

Specifically, the method for manufacturing glossy tone printed matter includes a lower layer formation process for forming a solid-liquid separation structure having a liquid surface as a lower layer, an upper layer formation process for applying and wet spreading droplets of an active energy ray curable composition as an upper layer on the lower layer, and a curing process for curing the upper layer or a liquid surface layer of the upper layer. At least a part of the upper layer and the lower layer may overlap.

In the lower layer formation process, preferably, the droplets of the active energy ray curable composition are irradiated with an active energy ray having an illuminance 0.8 to 1.49 times the maximum gloss illuminance, more preferably 0.9 to 1.2 times the maximum gloss illuminance, and specifically preferable 1 time the maximum gloss illuminance. If the illuminance is 0.8 times or less the maximum gloss illuminance of the gloss, the formation of pattern-shaped irregularities occurs, and the glossiness decreases. If the illuminance is 1.5 times or more the maximum gloss illuminance, the irregularities of the ink droplets become large, and the glossiness decreases.

A solidification process of solidifying the upper layer is not specifically limited, but is preferably an irradiation process for irradiating the upper layer with an active energy ray. The upper layer can be solidified in a continuous process. By this process, a solid surface rather than a liquid surface is formed. In the curing process for curing the upper layer, the upper layer may be irradiated with an active energy ray having the same illuminance as that in the lower layer formation process as a series of processes, and may be cured by the cumulative light due to light leakage during multi-pass printing. Alternatively, the upper layer may also be cured by an active energy ray having an illuminance 1.2 times or more the maximum gloss illuminance as a separate active energy ray irradiation. Furthermore, it is preferable that the upper layer is irradiated with an active energy ray having an illuminance 1.2 times or more the maximum gloss illuminance without being irradiated with an active energy ray having an illuminance less than 0.8 times the maximum gloss illuminance that is same as that in the lower layer formation process. The influence of the curing inhibition due to oxygen can be reduced by curing with one active energy ray irradiation, and a sufficient curing reaction proceeds easily.

<Other Processes and Other Devices>

The other processes are not specifically limited. They can suitably be selected to a particular application, and, specific examples include a control process.

The other devices are not specifically limited. They can suitably be selected to a particular application, and specific examples include a controller.

—Control Process and Controller—

The control process is process for controlling each process, and is preferably performed by the controller.

The controller is not specifically limited as long as the operation of each device can be controlled. It can suitably be selected to a particular application, and specific examples include equipment such as a sequencer or a computer.

(Device for Manufacturing Printer Matter and Method for Manufacturing Printed Matter of the Third Embodiment)

The device for manufacturing printed matter and the method for manufacturing printed matter of the third embodiment can manufacture printed matter having both a matte tone portion due to a pattern formation as shown in FIG. 1 and a glossy tone portion as shown in FIG. 3.

By combining the method for manufacturing matte tone printed matter (having pattern-shaped irregularities) of the first embodiment, the method for manufacturing glossy tone printed matter of the second embodiment, and another method for manufacturing matte tone printed matter (having a dot shape), printed matter having different glossiness portions can be manufactured.

The method for manufacturing printed matter of the third embodiment of the present disclosure includes a combination of a process comprising the method for manufacturing printed matter of the first embodiment and a process comprising the method for manufacturing printed matter of the second embodiment.

The process comprising the method for manufacturing printed matter of the first embodiment and the process comprising the method for manufacturing printed matter of the second embodiment are the same as the method for manufacturing printed matter of the first embodiment and the method for manufacturing printed matter of the second embodiment, respectively.

The device for manufacturing printed matter of the third embodiment of the present disclosure includes a combination of a device configured to perform the method for manufacturing printed matter of the first embodiment and a device configured to perform the method for manufacturing printed matter of the second embodiment.

The device configured to perform the method for manufacturing printed matter of the first embodiment and the device configured to perform the method for manufacturing printed matter of the second embodiment are the same as the device for manufacturing printed matter of the first embodiment and the device for manufacturing printed matter of the second embodiment, respectively.

The illuminance of the active energy ray is preferably adjusted by the adjusting the output of a light source that emits the active energy ray. As the surface curing state of the active energy ray curable composition is also influenced by the cumulative light amount, it may also possible to control the light amount, but specifically, the surface curing state is more susceptible to the illuminance. Further, the adjustment of the output has little influence on the other processes, and the operation thereof is simple. It is preferable that the glossiness is controlled within the range from the minimum output to the maximum output of the active energy ray, but the range of adjustment of the light amount may be broadened by providing a plurality of active energy ray light sources, adjusting the speed, increasing the number of scans, and the like.

The output (illuminance) of the active energy ray with which the resulting printed matter shows the maximum gloss may be any value within the range from the minimum output to the maximum output of the active energy ray. When a glossy tone portion (maximum gloss) is obtained with a low output, a matte tone portion derived from the shape of dots is obtained with a high output. When a glossy tone portion (maximum gloss) is obtained with a high output, a matte tone portion derived from pattern-shaped irregularities is obtained with a low output. When a glossy tone portion (maximum gloss) is obtained with an intermediate output, both a matte tone portion derived from the shape of dots and a matte tone portion derived from pattern-shaped irregularities can be obtained.

As to the range of the active energy ray output when controlling the gloss from a glossy tone to a matte tone, the illuminance ratio of the maximum illuminance to the minimum illuminance (maximum illuminance/minimum illuminance) is preferably 1.2 or more, more preferably 1.2 to 4, and 1.5 to 3 is specifically preferable. It is possible to control the change of the gloss from a glossy tone to a matte tone to the extent that the change can be recognized when the illuminance ratio (maximum illuminance/minimum illuminance) is in the range of 1.2 to 4.

If the illuminance ratio (maximum illuminance/minimum illuminance) is less than 1.2, the degree of the change of the gloss is large, thus, it is difficult to achieve the accuracy of the glossiness for the entire image. If the illuminance ratio (maximum illuminance/minimum illuminance) is in excess of 4, it becomes difficult to control by only the adjustment of the output of the same light source.

The method for manufacturing printed matter of the present disclosure is characterized in that, after the irradiation of droplets of the active energy ray curable composition with an active energy ray, other droplets of the active energy ray curable composition are applied so as to be brought into contact with the droplets of the active energy ray curable composition having been irradiated with the active energy ray. It is preferable that the other droplets are applied onto the droplets having been irradiated with the active energy ray while the droplets maintain a desired curing state after the irradiation. The expression "onto the droplets" is not limited to mean "directly above the droplets", and includes "in contact with the droplets".

In the case of a multi-pass system, when the printing process is divided too much, it is difficult for the ink droplets to come into contact with other ink droplets to be impacted thereafter while maintaining a desired curing state. Therefore, the number of passes in the multi-pass system is preferably 2 to 8 passes. In the case of a single pass system, it is preferable that the printing process forms 2 layers or more.

Further, the input image can also be processed. For example, the input image can be subjected to image processing which divides the image, and the divided images can be printed in sequence. The principle is unclear, but the variation of the glossiness can be increased thereby. The glossy image of the printed matter of the second embodiment can be printed more glossy, and the matte image of the printed matter of the first embodiment can be printed more matte. Specifically, the input image can be divided by dot unit of the inkjet droplets, for example, divided into four low density images each having a density of 25%, and the four images are printed in sequence to reproduce the input image with a density of 100%. Further, by dividing the input image, it is possible to prevent the coalescence of the ink droplets in an uncured state, making the image quality clear. It is not always necessary to process the input image itself, as long as the above-mentioned printing method is substantially sufficient.

When printing an image having a uniform glossiness, it is sufficient to print with an active energy ray having an illuminance corresponding to the desired glossiness. On the other hand, an image having a different glossiness depending on the portion can be printed by dividing the original input image into images with each glossiness, printing the divided images with an active energy ray having an illuminance corresponding to each glossiness, and combining the divided images to reproduce the original image. For example, an image can be reproduced including the glossiness thereof by measuring the color and the glossiness of the image, dividing the image into images with each glossiness, discharging the ink corresponding to the color measured for each divided image and irradiating the each divided image with an active energy ray having an illuminance corresponding to the glossiness of the divided image to form an image at each glossiness, and combining the images at each the glossiness to make one original image.

Preferably, the above-described processes are performed in the air, in particular, in the presence of oxygen. The surface of the applied curable composition is difficult to cure due to curing inhibition due to oxygen, because oxygen is easily supplied to the surface, thereby forming a solid-liquid separation structure having a liquid surface. By controlling the surface of the applied curable composition to be liquid or solid, the wettability to the droplets to be applied on the surface can be controlled, the shape of the droplets can be controlled, and the glossiness can be controlled.

(Printed Matter)

The glossiness of the printed matter of the present disclosure changes in accordance with the illuminance of the active energy ray with which irradiated during printing. Even when the same printer and the same active energy ray curable composition (ink) are used, printed matters having different glossiness can be manufactured according to the present disclosure. A change in the glossiness means that the difference of the glossiness changes within a recognizable range.

By combining the method for manufacturing matte tone printed matter (having pattern-shaped irregularities) of the first embodiment, the method for manufacturing glossy tone printed matter of the second embodiment, and another method for manufacturing matte tone printed matter (having a dot shape), printed matter having different glossiness portions can be manufactured.

The matte tone printed matter of the first embodiment has pattern-shaped irregularities on its surface, and exhibits a low glossiness. Further, the gloss ratio that is a ratio of 85-degree glossiness to 60-degree glossiness (85-degree glossiness/60-degree glossiness) is 1.3 or less, and preferably 1.1 or less. When the gloss ratio (85-degree glossiness/60-degree glossiness) is 1.3 or less, the pattern-shaped irregularities of the printed matter of the first embodiment can be sufficiently formed, and when 1.1 or less, the pattern-shaped irregularities can be sufficiently formed. It is considered that this pattern is a local pattern along the outline of the droplets, and is different from the arc-shaped gentle irregularity of the dot-shaped droplets. It is thought that the irregularities in the pattern-shaped irregularities can be formed more finely on the printed matter of the first embodiment, depending on the size of the droplets and the manner in which the droplets are impacted.

The glossiness is preferably controlled within the range in which the difference of the 60-degree glossiness is 20 degrees or more, more preferably 30 or more, and specifically preferably 40 or more. Further, one printed matter may have a uniform glossiness, or may have both a glossy tone portion and a matte tone portion or have a portion in which the glossiness is digitally and steplessly changed.

Note that, in the present disclosure, it is possible to include matte tone printed matter produced by a method for manufacturing matte tone printed matter derived from the dot shape as described below.

—Method for Manufacturing Matte Tone Printed Matter (Dot Shape)—

Figure 4:
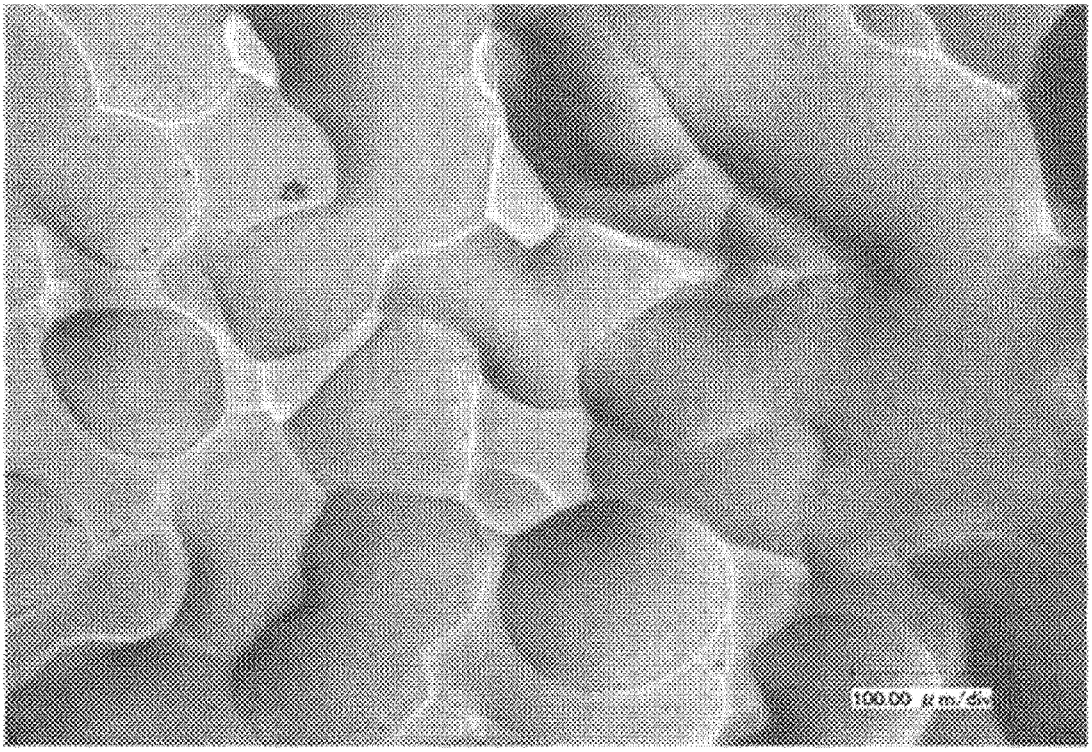
FIG. 4 is an enlarged image of a matte tone printed matter (having a dot shape)

In the method for manufacturing matte tone printed matter derived from the dot shape, in the same manner as a normal printing process for droplets of the active energy ray curable composition, the process of making droplets of an active energy ray curable composition to impact and curing the droplets by irradiation of an active energy ray to obtain a solid surface and the process of making other droplets of the active energy ray curable composition to impact thereon and cured them are repeated. As a result, printed matter as shown in FIG. 4 can be obtained.

The illuminance of the active energy ray for obtaining a solid surface is preferably an illuminance 1.2 to 4 times the maximum gloss illuminance, and is more preferably 1.5 to 3 times the maximum gloss illuminance. The greater the illuminance, the more the solid surface becomes dry, and the larger the contact angle of the droplets, thus, the irregularities derived from the dot shape become large and the glossiness decreases. If the illuminance is too large, it is difficult to control the illuminance within the adjustable range of the active energy ray output from the same light source. In addition, changes to the substrate, such as yellowing due to excessive irradiation, may be caused. In the case of adding a surfactant capable of imparting ink repellency, there are cases in which a sufficient contact angle can be obtained even when the illuminance of the active energy ray is 1.2 times to less than 1.5 times the maximum gloss illuminance. Further, increasing the amount of received light to increase the cumulative light amount is also effective, and when a sufficient solid surface cannot be obtained within the adjustable range of the active energy ray output, it is preferable to perform an additional irradiation of the active energy ray.

<<Active Energy Ray>>

The active energy rays used to cure the active energy ray curable composition are not specifically limited as long as they can provide the energy necessary for the polymerization reaction of the polymerizable components in the composition to proceed, and include, in addition to ultraviolet rays, electron beams, α-ray, β-ray, γ-ray, and X-rays. Specifically, when using a high energy light source, the polymerization reaction can proceed even without the use of a polymerization initiator. Further, in the case of irradiation with ultraviolet rays, a mercury-free light source is strongly desirable for protecting the environment, thus, the replacement to a GaN-based semiconductor ultraviolet light-emitting device is remarkably advantageous both industrially and environmentally. Furthermore, an ultraviolet light emitting diode (UV-LED) and an ultraviolet laser diode (UV-LD) are preferable as ultraviolet light sources as they are of small size, have a long life, a high efficiency, and a low cost. Thereamong, a metal halide ultraviolet light source is preferable for the non-uniform curing of the surface and the inside and the complete curing of the surface.

<<Active Energy Ray Curable Composition>>

The curing state of the active energy ray curable composition can be changed by the illuminance of the active energy ray. At a high illuminance, a state in which the surface is solidified is exhibited, and at a low illuminance, a solid-liquid separation state is exhibited in which the surface is liquid and the interior is solid. Namely, in the high illuminance condition, the wettability of the active energy ray curable composition becomes lower as the surface is solid, and in the low illuminance condition, the wettability of the active energy ray curable composition becomes significantly higher as the liquid component is present at the surface. When the wettability is low, the gloss is low, and when the wettability is high, the gloss essentially becomes high. Furthermore, if there is too much of the liquid component on the surface, the pattern-shaped irregularities are formed on the surface, and the gloss becomes low.

The active energy ray curable composition exhibiting these properties preferably forms the solid-liquid separation structure in a semi-cured state, and preferably contains a multifunctional monomer. When the composition does not contain a multifunctional monomer, the polymer obtained by the polymerization reaction is likely to dissolve in the active energy ray curable composition and cures uniformly without forming solid-liquid separation, thus, for example, forming a sticky substance without increasing the wettability of the active energy ray curable composition. On the one hand, when the composition contains a multifunctional monomer, a three-dimensional crosslinked structure is formed that is easy to separate from the unreacted components, and the composition is likely to non-uniformly cure, thus maintaining the liquid state of the surface and increasing the wettability of the droplets of the active energy ray curable composition.

Further, it is preferable that the composition possess the properties of curing from the interior, but due to the non-uniform curing, the curability of the interior becomes higher when the multifunctional monomer is added. The curing inhibition due to oxygen can be utilized to decrease the curability of the surface more than the curability of the interior. The monomer is preferably radical polymerizable, and is better not to be influenced by the curing inhibition due to oxygen. The liquid surface in the low illuminance condition is preferably completely cured by an additional irradiation. It is preferable that the main components of the liquid surface in the low illuminance condition include solid-liquid separated unreacted monomer components, and the addition of a multifunctional monomer which causes non-uniform curing is preferable.

When printing using an ink set which combines two or more inks each comprising an active energy ray curable composition, it is preferable that the change of the glossiness in accordance with the change of the illuminance of an active energy ray is uniform among the inks in the ink set. Specifically, it is preferable that the illuminance of the active energy ray with which the gloss is maximized is uniform among the inks in the ink set. The ratio in the maximum gloss illuminance of the active energy ray between at least two from among at least four inks is preferably 1.5 or less, and is more preferably 1.2 or less. Furthermore, it is preferable that the ratio is 1.2 or less among all the inks of the ink set. If the ratio is 1.2 or less, the behavior of the gloss change between the colors becomes closer, thus, the adjustment of the gloss becomes simple. There are inks which hardly influence the glossiness, and the printing process may be divided according to the illuminance of the active energy ray, thus, it is not necessary that the maximum gloss illuminance of the active energy ray for all of the inks be uniform.

The active energy ray curable composition preferably comprises a monomer and a polymerization initiator, and further comprises a colorant, an organic solvent, and other components in accordance with need.

—Monomer—

The monomer is a compound which causes a polymerization reaction and cures by an active energy ray (ultraviolet rays, electron beam, etc.) or by an active species generated by an active energy ray. Specific examples of the monomer include, but are not limited to, a multifunctional monomer and a monofunctional monomer, classified in accordance with the number of functional groups. The monomer may be a polymerizable composition, and may contain a polymerizable oligomer and/or a polymerizable polymer (macromonomer). These may be used singly or in combinations of two or more.

—Multifunctional Monomer—

Specific examples of the multifunctional monomer include, but are not limited to, a difunctional monomer, a trifunctional monomer, and a monomer having a number of functional groups greater than the above.

The multifunctional monomer is not particularly limited. It can suitably be selected to a particular application. Specific examples of the multifunctional monomer include, but are not limited to, neopentyl glycol di(meth)acrylate, (poly) ethylene glycol di(meth)acrylate, diethylene glycol di(meth) acrylate, triethylene glycol di(meth)acrylate, tetraethylene glycol di(meth)acrylate, polypropylene glycol di(meth)acrylate, dipropylene glycol di(meth)acrylate, tripropylene glycol di(meth)acrylate, (poly)tetratmethylene glycol di(meth) acrylate, di(meth)acrylate of bisphenol A propylene oxide (PO) adduct, ethoxylated neopentyl glycol di(meth)acrylate, propoxylated neopentyl glycol di(meth)acrylate, di(meth) acrylate of bisphenol A ethylene oxide (EO) adduct, pentaerythritol tri(meth)acrylate, EO-modified pentaerythritol tri(meth)acrylate, PO-modified pentaerythritol tri(meth) acrylate, EO-modified pentaerythritol tetra(meth)acrylate, PO-modified pentaerythritol tetra(meth)acrylate, EO-modified dipentaerythritol tetra(meth)acrylate, PO-modified dipentaerythritol tetra(meth)acrylate, trimethylolpropane tri (meth)acrylate, EO-modified trimethylolpropane tri(meth) acrylate, PO-modified trimethylolpropane tri(meth)acrylate, EO-modified tetramethylolmethane tetra(meth)acrylate, PO-modified tetramethylolmethane tetra(meth)acrylate, pentaerythritol tetra(meth)acrylate, dipentaerythritol tetra (meth)acrylate, trimethylolpropane tri(meth)acrylate, tetramethylolmethane tetra(meth)acrylate, trimethylolethane tri(meth)acrylate, bis-(4-(meth)acryloxypolyethoxyphenyl)propane, diallyl phthalate, triallyl trimellitate, 1,6-hexanediol di(meth)acrylate, 1,9-nonanediol di(meth) acrylate, 1,3-butylene glycol di(meth)acrylate, 1,10-decanediol di(meth)acrylate, neopentyl glycol hydroxypivalate di(meth)acrylate, tetramethylolmethane tri (meth)acrylate, dimethylol tricyclodecane di(meth)acrylate, modified glycerin tri(meth)acrylate, bisphenol A diglycidyl ether (meth)acrylic acid adduct, modified bisphenol A di(meth)acrylate, caprolactone-modified dipentaerythritol hexa(meth)acrylate, dipentaerythritol hexa(meth)acrylate, pentaerythritol tri(meth)acrylate tolylene diisocyanate urethane prepolymer, pentaerythritol tri(meth)acrylate hexamethylene diisocyanate urethane prepolymer, ditrimethylolpropane tetra(meth)acrylate, pentaerythritol tri(meth) acrylate hexamethylene diisocyanate urethane prepolymer, urethane (meth)acrylate oligomer, epoxy acrylate oligomers, polyester acrylate oligomer, polyether acrylate oligomer, and silicon acrylate oligomer. These may be used singly or in combinations of two or more.

In order to form a three-dimensional crosslink structure to become insoluble in the ink liquid, the content of the multifunctional monomer is preferably 50% by mass or more, and more preferably 70% by mass or more, relative to the total amount of monomers, so that a dense crosslinked structure is preferably formed. Further, the double bond equivalence (molecular weight/number of functional groups) is preferably 200 or less, and more preferably 160 or less. When these conditions are satisfied, the polymer which reacted with the unreacted monomer easily forms a curing state in which the solid and liquid are separated, thus, the surface curing state which expresses the gloss of the present disclosure is easily formed, and the liquid surface (semi-cured state) easily shifts to the complete curing state.

The number of functional groups in the multifunctional monomer is preferably 2 to 6, and a difunctional monomer is particularly preferable. The lower the number of functional groups, the lower the viscosity, and the viscosity of the liquid surface also becomes low, thus, the change of the wettability due to the curing state, i.e., the control range of the glossiness can also become large.

—Monofunctional Monomer—

The monofunctional monomer is not particularly limited. It can suitably be selected to a particular application. Specific examples of the monofunctional monomer include, but are not limited to, hydroxyethyl (meth)acrylamide, (meth) acryloylmorpholine, dimethylaminopropyl acrylamide, isobornyl (meth)acrylate, adamantyl (meth)acrylate, 2-methyl-2-adamantyl (meth)acrylate, dicyclopentenyl (meth)acrylate, dicyclopentanyl (meth)acrylate, dicyclopentenyloxyethyl (meth)acrylate, 3,3,5-trimethylcyclohexane (meth)acrylate, t-butyl (meth)acrylate, tetrahydrofurfuryl (meth)acrylate, cyclohexyl (meth)acrylate, benzyl (meth) acrylate, 2-hydroxyethyl (meth)acrylate, 2-hydroxypropyl (meth)acrylate, 2-hydroxybutyl (meth)acrylate, isobutyl (meth)acrylate, phenoxyethyl (meth)acrylate, (2-methyl-2-ethyl-1,3-dioxolane-4-yl)-methyl (meth)acrylate, and cyclic trimethylolpropane formal (meth)acrylate. These may be used singly or in combinations of two or more. Among these monofunctional monomers, (meth)acryloylmorpholine and benzyl (meth)acrylate are preferable.

The content of the monofunctional monomer is preferably low for the curability for solid-liquid separation. If too much monofunctional monomer is added, a sticky cured product rather than a solid-liquid separation structure is obtained at the semi-cured stage during curing, thus, it is difficult to liquefy the surface and express the wettability even with an active energy ray having a low illuminance. However, the greater the content, the lower the viscosity tends to become, thus, it is preferable to add a large amount of monofunctional monomer within the range at which the curability can express the properties of the present disclosure.

—Polymerization Initiator—

The active energy ray curable composition may comprise a polymerization initiator. The polymerization initiator produces an active species such as radicals or cations due to the energy of the active energy ray, and may initiate polymerization of a polymerizable compound (monomer or oligomer). Known radical polymerization initiators, cationic polymerization initiators, and base generating agents can be used singly or in combination of two or more as the polymerization initiator, and thereamong, radical polymerization initiators are preferable in the present disclosure. Curing inhibition of radical polymerization due to oxygen at the surface of the composition can be utilized to develop the curing state necessary for the present disclosure. Further, the content of the polymerization initiator is preferably 5% by mass to 20% by mass relative to the total mass (100% by mass) of the composition in order to obtain a sufficient curing speed. Further, since the blending of the polymerization initiator influences gloss control by the illuminance of the active energy ray, it is preferable that the content is adjusted for each color ink, and the maximum gloss illuminance of the active energy ray in made uniform among the inks within the ink set.

Specific examples of the radical polymerization initiator include, but are not limited to, aromatic ketones, acylphosphine oxide compounds, aromatic onium chlorides, organic peroxides, thio compounds (thioxanthone compounds, thiophenyl group containing compounds, etc.), hexaaryl biimidazole compounds, ketoxime ester compounds, borate compounds, azinium compounds, metallocene compounds, active ester compounds, compounds having a carbon halogen bond, and alkyl amine compounds.

Further, in addition to the aforementioned polymerization initiators, a polymerization accelerator (sensitizer) can be used in combination. The polymerization accelerator is not specifically limited. It can suitably be selected to a particular application. Specific examples thereof include, but are not limited to, trimethylamine, methyldimethanolamine, triethanolamine, p-diethylaminoacetophenone, ethyl p-dimethylaminobenzoate, p-dimethylamino benzoic acid-2-ethylhexyl, N,N-dimethylbenzylamine, and 4,4'-bis (diethylamino)benzophenone. The content of the sensitizer may be appropriately set according to the polymerization initiator to be used and the amount thereof.

—Colorants—

The active energy ray curable composition may also comprise a colorant.

Various pigments and dyes that impart colors such as black, white, magenta, cyan, yellow, green, orange, and gloss colors such as gold and silver can be used as the colorant in accordance with the purposes and demanded properties of the composition in the present disclosure.

The content of the colorant is not specifically limited, and may be appropriately determined with reference to the desired color density and the dispersibility of the colorant in the composition, but is preferably 0.1% by mass to 30% by mass relative to the total mass (100% by mass) of the composition. Note that, the active energy ray curable composition may not contain a colorant and may be clear and colorless, and in this case, for example, the composition is suitable as an overcoating layer for protecting an image.

Inorganic pigments or organic pigments can be used as the pigment, and may be used alone or in combinations of two or more.

As the inorganic pigment, carbon blacks (C. I. Pigment Black 7) such as Furnace black, Lamp black, acetylene black, and Channel black; iron oxide; and titanium oxide can be used.

Specific examples of the organic pigment include, but are not limited to, azo pigments such as insoluble azo pigments, condensed azo pigments, azo lakes, and chelate azo pigments, polycyclic pigments such as phthalocyanine pigments, perylene pigments, perinone pigments, anthraquinone pigments, quinacridone pigments, quinacridone pigments, dioxane pigments, thioindigo pigments, isoindolinone pigments, and quinophthalone pigments, dye chelates (e.g., basic dye chelates and acid dye chelates), dye lakes (e.g., basic dye lakes and acid dye lakes), nitro pigments, nitroso pigments, aniline blacks, and daylight fluorescent pigments.

Further, a dispersant may be further included to make the dispersibility of the pigment even better. The dispersant is not specifically limited, and, examples thereof include dispersants commonly used for preparing pigment dispersions such as high-molecular-weight dispersants.

Specific examples of the dyes which can be used include, but are not limited to, acid dyes, direct dyes, reactive dyes, and basic dyes. These may be used singly or in combinations of two or more.

—Organic Solvent—

The active energy ray curable composition may also contain an organic solvent, but if possible, it is preferable to not contain an organic solvent. A composition free of any organic solvent, specifically free of any volatile organic compound (VOC), has greater safety in the location where the composition is handled, and it is possible to prevent environmental pollution. Note that, an "organic solvent" refers to a general non-reactive organic solvent, such as ether, ketone, xylene, ethyl acetate, cyclohexanone, and toluene, and is distinguished from a reactive monomer. Further, "free of" an organic solvent means that no organic solvent is substantially contained, and the content thereof is preferably less than 0.1% by mass.

—Other Components—

The active energy ray curable composition may also contain other well-known components in accordance with need.

The other components are not specifically limited, and examples thereof include conventionally known surfactants, polymerization inhibitors, leveling agents, antifoaming agents, fluorescent brightening agents, permeation enhancing agents, wetting agents (humectants), fixing agents, viscosity stabilizers, fungicides, preservatives, antioxidants, ultraviolet rays absorbents, chelate agents, pH adjusters, and thickeners.

—Preparation of Active Energy Ray Curable Composition—

The active energy ray curable composition can be prepared using the various components described above, and the preparation means and conditions are not specifically limited. The curable composition can be prepared by, for example, charging a polymerizable monomer, a pigment, a dispersant, and the like in a dispersing machine such as a ball mill, a kitty mill, a disk mill, a pin mill, and a DYNO-MILL, dispersing them to prepare a pigment dispersion liquid, and further mixing the pigment dispersion liquid with the polymerizable monomer, an initiator, a polymerization inhibitor, a surfactant, and the like.

<Viscosity>

The viscosity of the active energy ray curable composition is not specifically limited, and may be appropriately adjusted in accordance with the purpose and application means. For example, when the composition is used in a discharge device that discharges the composition from a nozzle, the viscosity is preferably 3 to 40 mPa·s, more preferably 5 to 15 mPa·s, and particularly preferably 6 to 12 mPa·s in the temperature range of 20° C. to 65° C., preferably at 25° C. to 50° C. Further, it is particularly preferable that the composition satisfies this viscosity range without containing the organic solvent described above. Note that, the aforementioned viscosity can be measured by a cone plate rotary viscometer (VISCOMETER TVE-22L manufactured by TOKI SANGYO CO., LTD.) using a cone rotor (1°34'×R24) at a rotational speed of 50 rpm, and appropriately setting the temperature of the constant-temperature circulating water in the range of 20° C. to 65° C. A VISCOMATE VM-150III can be used for the temperature adjustment of the circulating water.

<Use Application>

The use application of the active energy ray curable composition is not particularly limited as long as it is a field in which active energy ray curable materials are generally used. It can suitably be selected to a particular application. Examples thereof include a resin for processing, a paint, an adhesive, an insulant, a release agent, a coating material, a sealing material, various resists, and various optical materials.

Furthermore, the active energy ray curable composition can be used as not only an ink to form two-dimensional texts, images, and designed coating film on various substrates, but also a solid object forming material to form a three-dimensional image and a three-dimensional object (stereoscopic modeled object) having surface irregularities. The method for manufacturing printed matter of the present disclosure can control the gloss of the printed matter from gloss to matte, and can be used for manufacturing three-dimensional images having surface irregularities such as decorative printings having different glossy feeling and reproduction of an oil painting and three-dimensional stereoscopic modeled objects.

Figure 5:
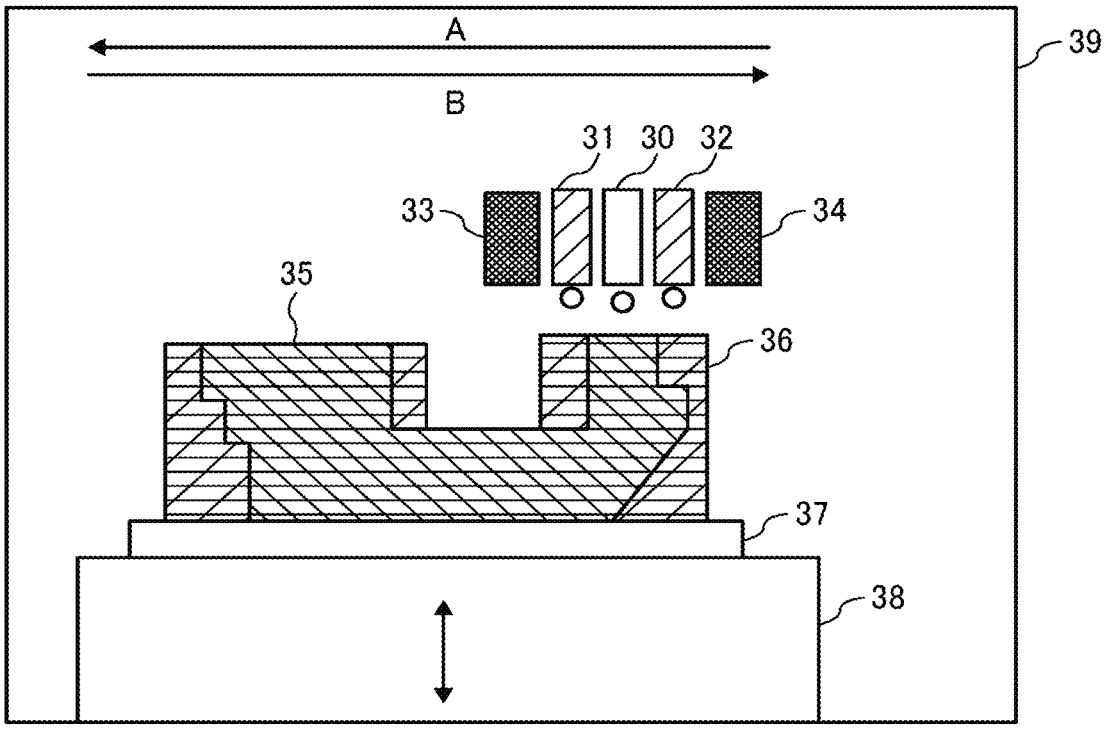
FIG. 5 is a schematic view illustrating an image forming device according to an embodiment of the present invention.
Figure 6A:
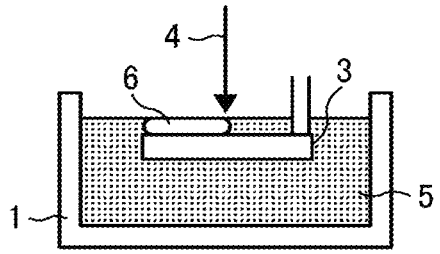
FIGS. 6A to 6D are schematic views illustrating an image forming device according to an embodiment of the present invention.
Figure 6B:
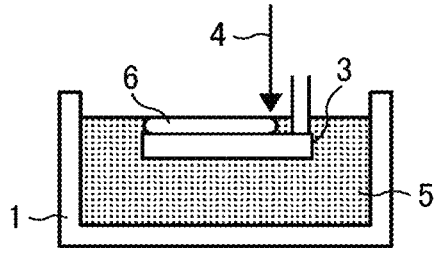
Figure 6C:
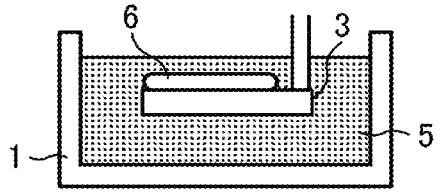
Figure 6D:
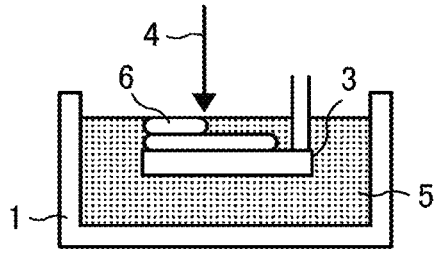

This three-dimensional solid object forming material may also be used as a binder for powder particles used in a powder laminating method that repeats curing and lamination of powder layers to form a three-dimensional object. The solid object forming material may also be used as a three-dimensional constituent material (model material) and a support member (support material) used in an additive manufacturing (stereolithography) as shown in FIG. 5 and FIGS. 6A to 6D. The irregularities and the glossiness of the surface of the stereoscopic modeled object can be controlled. Note that, FIG. 5 shows a method for discharging an active energy ray curable composition in a predetermined region, curing the composition by irradiation with an active energy ray, and sequentially laminating the cured composition to perform solid object formation (the details will be described below), and FIGS. 6A to 6D show another method for irradiating an active energy ray curable composition 5 in a storing pool (storing container) 1 with an active energy ray 4 to form a cured layer 6 having a predetermined shape on a movable stage 3, and sequentially laminating these layers to form a solid object.

A known solid object formation device for forming a stereoscopic modeled object using an active energy ray curable composition can be used and is not specifically limited. For example, the solid object formation device includes a storing container, a supplier, and a discharger for composition, and an active energy ray irradiator.

Further, the present disclosure includes a formed article obtained by processing a cured product obtained by curing the active energy ray curable composition or by processing a structure in which the cured product is formed on a substrate.

The substrate is not particularly limited. It can be suitably selected to a particular application. Examples of the substrate include, but are not limited to, paper, threads, fibers, fabrics, leathers, metals, plastics, glass, woods, ceramics, and composite materials thereof. Thereamong, plastics are preferable for the processability.

<Composition Storing Container>

A composition storing container refers to a container having the active energy ray curable composition stored therein, and is suitable for the aforementioned use applications. For example, in the case when the active energy ray curable composition is used as an ink, the container having the ink stored therein can be used as an ink cartridge or an ink bottle, and accordingly, direct contact with the ink during operations such as the transfer or the replacement of the ink is unnecessary so that the contamination of fingers and clothes can be prevented. Further, the inclusion of foreign materials such as dust in the ink can be prevented. Further, the shape, size, material, etc., of the container itself are not specifically limited as long as they are suitable for the applications and uses. It is preferable that the material is a light blocking material which does not transmit light or it is preferable to cover the container with a light blocking sheet, etc.

<Image Forming Device>

The image forming device includes an irradiator configured to irradiate an active energy ray, and a container storing the active energy ray curable composition. The container may comprise the aforementioned storing container. Furthermore, the image forming device may also includes a discharger configured to discharge the active energy ray curable composition. The method for discharging the active energy ray-curable composition is not specifically limited, and the discharger may be of a continuous injection type or an on-demand type. Specific examples of the one-demand type include, but are not limited to, piezo methods, thermal methods, and electrostatic methods.

An example of the image forming device is equipped with an inkjet discharger. Color printing units equipped with ink cartridges and discharge heads for respective active energy ray curable inks of yellow, magenta, cyan, black, white, and clear discharge the respective inks onto a recording medium. Then, light sources provided in the printing units irradiate the inks with an active energy ray to cure the inks. Then, the aforementioned image formation is repeated to manufacture printed matter.

In the present disclosure, the illuminance of the active energy ray from the light sources is adjusted. A matte tone derived from the ink-droplet-shaped irregularities is printed at a high illuminance, a glossy tone is printed at an intermediate illuminance, and a matte tone derived from pattern-shaped irregularities is printed at a low illuminance. Further, a series of irradiations may be carried out at the same illuminance, but with regards to the active energy ray irradiation immediately after the impact of the ink on the outermost surface, in order to reduce the influence of curing inhibition due to oxygen, it is preferable to set the illuminance high to solidify the surface at once irrespective of the desired glossiness. The wettability of the ink droplets depends on the active energy ray illuminance irradiated beforehand, thus, the wettability of the ink droplets on the outermost surface does not depend on the subsequent active energy ray illuminance. In order promote the curing of the surface, additional irradiations may be carried out after the completion of the image formation.

Each color printing unit may have a heating mechanism so as to liquefy the ink in the ink discharging unit. Further, in accordance with need, a mechanism for cooling the recording medium to around room temperature in a contact or non-contact manner may be provided. Further, either a serial method for discharging the ink onto the recording medium by moving the printer head while the recording medium intermittently moves in accordance with the width of the discharge head or a line method for discharging the ink on the recording medium from a printer head held at a fixed position while the recording medium moves continuously can be used as the inkjet recording system.

The recording medium is not specifically limited, but may be made of paper, a film, a metal, or a composite material thereof, and may have a sheet-like shape. Further, the recording medium may have a configuration applicable to both one-side printing and duplex printing.

The recorded matter to be recorded by the active energy ray curable composition not only includes the recorded matter printed on a smooth surface such as conventional paper or resin film, but also includes recorded matter printed on a surface having an irregularity and recorded matter printed on a surface consisting of various materials such as metals or ceramics.

FIG. 5 is a schematic view illustrating an image forming device (three dimensional image forming device) according to the present disclosure. An image forming device 39 of FIG. 5 uses a head unit (moveable in the direction indicated by arrows A and B) in which inkjet heads are arranged. A first active energy ray curable composition is discharged from a discharge head unit 30 for molding object, a second active energy ray curable composition different in composition from the first active energy ray curable composition is discharged from discharge head units 31 and 32 for support, and the discharged compositions are cured by adjacent ultraviolet ray illumination means 33 and 34 while being laminated. More specifically, the process for discharging the second active energy ray curable composition from the discharge head units 31 and 32 for support onto a modeled object support substrate 37 and irradiating with the active energy ray to solidify to form a first support layer having a reservoir, and the process for discharging the first active energy ray curable composition from the discharge head unit 30 for molding object onto the reservoir and irradiating with the active energy ray to solidify to form a first molding object layer while lowering a stage 38 that is moveable in the vertical direction in accordance with the number of laminations are repeated, to laminate the support layers and the molding object layers to produce a stereoscopic modeled object 35. Then, a support lamination layer 36 is removed in accordance with need. Note that, in FIG. 5, only one discharge head unit 30 for molding object is provided, but two or more of them may be provided.

EXAMPLES

Below, the present disclosure is further described using examples, but the present disclosure is not limited by these examples. Note that, in the following examples, an example using an "ultraviolet ray curable ink" is illustrated as an example of the "active energy ray curable composition".

Production Examples 1 to 5

—Production of Ultraviolet Ray Curable Inks 1 to 5—

Each of the compositions shown in Table 1 was mixed and stirred at room temperature to produce each of the ultraviolet ray curable inks 1 to 5. Note that, the numbers in Table 1 are "parts (pts.) by mass".

TABLE 1

| Component (pts. mass) | | UV curable ink No. 1 | 2 | 3 | 4 | 5 |
|---|---|---|---|---|---|---|
| Monofunctional monomer | ACMO | 10 | 10 | — | 25 | 53 |
| | Bza | 9 | 9 | 39 | 23 | 47 |
| Multifunctional monomer | TPGDA | 81 | — | — | 52 | — |
| | PPGDA | — | 81 | — | — | — |
| | TMPTA | — | — | 61 | — | — |
| Polymerization initiator | Irgacure819 | 4 | 4 | 4 | 4 | 4 |
| | Irgacure379 | 3 | 3 | 3 | 3 | 3 |
| Colorant | PB 15:4 | 3 | 3 | 3 | 3 | 3 |

Note that, in Table 1, the product name and the company manufacturing the component are as follows.

—Monofunctional Monomer— acryloylmorpholine (ACMO): manufactured by KJ Chemical Corporation benzyl acrylate (BZA): manufactured by Osaka Organic Chemical Industry Ltd., Viscoat #160

—Multifunctional Monomer— tripropylene glycol diacrylate (TPGDA): manufactured by Shin Nakamura Chemical Co. Ltd., APG-200 polypropylene glycol diacrylate (PPGDA): manufactured by Shin Nakamura Chemical Co. Ltd., APG-400 trimethylolpropane triacrylate (TMPTA): manufactured by Osaka Organic Chemical Industry Ltd., Viscoat #295

—Polymerization Initiator— bis (2,4,6-trimethylbenzoyl)-phenylphosphine oxide: manufactured by BASF SE, Irgacure 819

2-(dimethyl amino)-2-[(4-methyl-phenyl)-methyl]-1-[4-(4-morpholinyl)phenyl]-1-butanone: manufactured by BASF SE, Irgacure 379

—Colorant— copper phthalocyanine: PB15:4 (manufactured by Dainichiseika Color & Chemicals Mfg. Co., Ltd.)

Example 1

—Preparation of Printed Matter 1—

A solid image was printed using an inkjet discharge device equipped with a MH5421 head (manufactured by Ricoh Company Ltd.) by one direction printing (only in the forward path) with the obtained ultraviolet ray curable ink 1 at a resolution of 600 dpi×600 dpi, an amount of 20 pL per droplet, a printing speed of 840 mm/s, and ultraviolet ray illuminance specified below.

The printing and UV irradiation were performed as a series of operations by mounting a Cool Arc manufactured by Baldwin Japan Ltd. on the right side of the head as a ultraviolet ray light source and printing in a lit state. This operation is deemed to be one pass, and an 8-pass printing was performed. The distance between the head and the light source was set to 300 mm.

Note that, printed matter was manufactured at an illuminance between 0.25 W/cm$^2$ and 1.00 W/cm$^2$ at 0.05 W/cm$^2$ intervals. At the illuminance of 1.00 W/cm$^2$, UV irradiation was performed twice, to obtain printed matter manufactured by doubling the light amount.

The illuminance (W/cm$^2$) and the light amount (mJ/cm$^2$) were measured in the UVA region of UV Power Puck (Registered Trademark) II (manufactured by EIT, LLC).

A polycarbonate substrate (Product name: Iupilon NF-2000, manufactured by Mitsubishi Gas Chemical Company Inc., average thickness of 0.5 mm) was used as the substrate.

Example 2

—Preparation of Printed Matter 2—

Printed matter 2 was prepared in the same manner as Example 1 with the exception that the solid image of Example 1 was divided into four parts by the dot unit, and each obtained image having a density of 25% was printed in order to obtain one image.

Example 3

—Preparation of Printed Matter 3—

Printed matter 3 was prepared in the same manner as Example 1 with the exception that the ultraviolet ray curable ink 2 was used in place of the ultraviolet ray curable ink 1 in Example 1.

Example 4

—Preparation of Printed Matter 4—

Printed matter 4 was prepared in the same manner as Example 1 with the exception that the ultraviolet ray curable ink 3 was used in place of the ultraviolet ray curable ink 1 in Example 1.

Example 5

—Preparation of Printed Matter 5—

Printed matter 5 was prepared in the same manner as Example 1 with the exception that the ultraviolet ray curable ink 4 was used in place of the ultraviolet ray curable ink 1 in Example 1.

Comparative Example 1

—Preparation of Printed Matter 6—

Printed matter 6 was prepared in the same manner as Example 1 with the exception that the ultraviolet ray curable ink 5 was used in place of the ultraviolet ray curable ink 1 in Example 1.

Next, the properties were evaluated for each of the obtained printed matters as follows. The results are shown in Table 2 and Table 3.

<Semi-Cured State>

For the evaluation of the state of the surface of printed matter in a semi-cured state, a printed matter was manufactured at a low illuminance of 0.25 W/cm$^2$, touched to determine whether the surface was "solid", "sticky", or "liquid", and evaluated based on the following evaluation criteria.

[Evaluation Criteria]

Solid: In a dry state, there is no stickiness or slime.

Sticky: There is stickiness and tackiness.

Liquid: There is slime. The liquid adheres to the hand.

<Pattern Formation of Irregularity Shape>

Microscopic observation was performed on the surface shape of the printed matter manufactured at an illuminance of 0.25 W/cm$^2$, and was evaluated by the following criteria.

[Evaluation Criteria]

A: As shown in FIG. 1, a pattern shape of the outlines of the dots of the ink droplets are clearly visible.

B: As shown in FIG. 2, a pattern shape of a trace of the outlines of the dots of the ink droplets is slightly visible.

C: As shown in FIG. 3, a smooth surface is obtained and no pattern shape is observed.

<Glossiness>

The 60-degree glossiness was measured for each printed matter using Microgloss manufactured by BYK Gardner.

<Maximum Gloss Illuminance>

The glossiness of the printed matters manufactured at an illuminance between 0.25 W/cm$^2$ and 1.00 W/cm$^2$ at 0.05 W/cm$^2$ intervals was measured by the aforementioned method, and the illuminance at which the maximum value of gloss was exhibited was made as the maximum gloss illuminance. Note that, when the difference between the maximum glossiness and the minimum glossiness within the printed matter manufactured at each illuminance, including the printed matter being irradiated twice at an illuminance of 1.00 W/cm$^2$, was 10 or less, it was deemed that there was no significant difference and the maximum gloss was not present ("None").

TABLE 2

| | | | Ex. 1 | Ex. 2 | Ex. 3 | Ex. 4 | Ex. 5 |
|---|---|---|---|---|---|---|---|
| | Printed matter | | 1 | 2 | 3 | 4 | 5 |
| | UV curable ink No. | | 1 | 1 | 2 | 3 | 4 |
| | Image processing | | Normal | 4 divisions | Normal | Normal | Normal |
| Curability | Semi-cured state | 0.25 W/cm$^2$ irradiation | Liquid | Liquid | Liquid | Liquid | Liquid |
| | Pattern formation | Illuminance 0.25 W/cm$^2$ | A | A | B | A | B |
| Glossiness | Presence of maximum value | | Present | Present | Present | Present | Present |
| | Maximum UV illuminance | W/cm$^2$ | 0.7 | 0.65 | 0.4 | 0.65 | 0.4 |
| | 60-degree glossiness | Illuminance 0.25 W/cm$^2$ | 42.1 | 24.8 | 35.1 | 37.2 | 35.6 |
| | | Maximum UV illuminance time | 55.9 | 68.7 | 38.3 | 48.1 | 36.9 |
| | | Illuminance of 1.00 W/cm$^2$ | 45.5 | 56.4 | 29.8 | 40.6 | 27.7 |
| | | Illuminance of 1.00 W/cm$^2$* | 28.5 | 39.8 | 22.6 | 25.4 | 20.9 |
| | Glossiness difference | Maximum − minimum | 27.4 | 43.9 | 15.7 | 22.7 | 16.0 |

TABLE 3

| | | | Comp ex. 1 |
|---|---|---|---|
| | Printed matter | | 6 |
| | UV curable ink No. | | 5 |
| | Image processing | | Normal |
| Curability | Semi-cured state | 0.25 W/cm$^2$ irradiation | Stickiness |
| | Pattern formation | Illuminance 0.25 W/cm$^2$ | C |
| Glossiness | Presence of maximum value | | C |
| | Maximum UV illuminance | [W/cm$^2$] | — |
| | 60-degree glossiness | Illuminance 0.25 W/cm$^2$ | 9.8 |
| | | Maximum UV illuminance time | — |
| | | Illuminance of 1.00 W/cm$^2$ | 12.9 |
| | | illuminance of 1.00 W/cm$^2$* | 12.4 |
| | Glossiness difference | Maximum − minimum | 3.5 |

<Glossiness of Matte Tone Printed Matter Having Pattern Shape>

The 60-degree glossiness and the 85-degree glossiness for matte tone printed matters 1 and 2 having different shapes were respectively measured by Microgloss manufactured by BYK Gardener, and the gloss ratio (85-degree glossiness/60-degree glossiness) was obtained. The results are shown in Table 4.

TABLE 4

| | | | 60-degree glossiness | 85-degree glossiness | Gloss ratio | |
|---|---|---|---|---|---|---|
| Matte coated pattern shape | Printed matter 1 | Illuminance 0.25 W/cm$^2$ | 42.1 | 44.5 | 1.06 | Example |
| | Printed matter 2 | | 24.6 | 24.6 | 0.99 | |
| | Printed matter 2 | Illuminance 0.4 W/cm$^2$ | 29.3 | 37 | 1.26 | |
| Matte coated dot shape | Printed matter 1 | Illuminance 1.0 W/cm$^2$* | 26.5 | 40.3 | 1.41 | Comp ex. |
| | Printed matter 2 | | 39.8 | 54.6 | 1.37 | |

As is clear from the results of Table 4, it is known that generally, the greater the incidence angle, the higher the glossiness. Thus, the gloss ratio (85-degree glossiness/60-degree glossiness) becomes sufficiently greater than 1. On the one hand, since pattern-shaped irregularities are imparted onto a smooth surface in matte tone printed matter derived from a pattern shape, when the incidence angle is large, the reflected light tends to be obstructed strongly due to the irregularities, and when the incidence angle is small, there is a strong tendency for the reflection to become large due to the smooth surface. Thus, it is considered that the gloss ratio (85-degree glossiness/60-degree glossiness) becomes lower than usual, and the gloss ratio (85-degree glossiness/60-degree glossiness) becomes 1.3 or less.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A method for manufacturing printed matter, comprising:

irradiating applied droplets of an active-enemy-ray-curable composition with a first active energy ray having an illuminance less than a predetermined illuminance;

applying additional droplets of the active-energy-ray-curable composition onto the applied droplets irradiated in the irradiating step; and solidifying a surface of the additional droplets by irradiating the additional droplets of the active-energy-ray-curable composition applied in the applying step with a second active energy ray having an illuminance greater than the predetermined illuminance, wherein the irradiating step forms a solid-liquid separation structure having a liquid surface, and the applying step forms pattern-shaped irregularities.

2. The method according to claim 1, wherein the luminance of the second active energy ray is 1.2 times the predetermined illuminance or more, and the luminance of the first active energy ray is 0.8 times the predetermined illuminance or less.

3. The method according to claim 1, wherein the first active energy ray has an illuminance 0.5 times the predetermined illuminance or less.

4. The method according to claim 1, further comprising:

dividing an input image by dot unit to obtain low density images; and repeating the irradiating step and the applying step to print the low density images in sequence to reproduce the input image.

5. The method according to claim 4, further comprising:

forming an outermost surface of each of the low density images by irradiating the additional droplets of the active-energy-ray-curable composition applied in the applying step with the second active energy ray having an illuminance 1.2 times the predetermined illuminance or more.

6. The method according to claim 1, wherein the active-energy-ray-curable composition comprises a multifunctional monomer having two or more functional groups accounting for 50% by mass or more of a total amount of monomers.

7. The method according to claim 1, wherein the irradiating and applying steps are carried out in an atmosphere.

8. The printed matter manufactured by the method according to claim 1, wherein the printed matter has a gloss ratio of 1.3 or less, the gloss ratio being a ratio of an 85-degree glossiness to a 60-degree glossiness.

9. The printed matter according to claim 8, wherein the gloss ratio is 1.1 or less.

10. The method of claim 1, wherein the predetermined illuminance is determined by measuring a gloss of each of a plurality of printed matters manufactured using the active-energy-ray-curable composition using a corresponding plurality of active energy ray illuminance values, and selecting one of the active energy ray illuminance values at which the measured gloss was maximum.

11. The method of claim 1, wherein the applied droplets and the additional droplets have a same composition.

12. A method for manufacturing printed matter, comprising:

irradiating applied droplets of an active-energy-ray-curable composition with a first active energy ray having an illuminance 0.8 to 1.49 times a predetermined illuminance; and applying additional droplets of the active-energy-ray-curable composition onto the applied droplets irradiated in the irradiating step, wherein the predetermined illuminance is determined by measuring a gloss of each of a plurality of printed matters manufactured using the active-energy-ray-curable composition using a corresponding plurality of active energy ray illuminance values, and selecting one of the active energy ray illuminance values at which the measured gloss was maximum.

13. The method according to claim 12, further comprising:

solidifying a surface of the additional droplets by irradiating the additional droplets of the active-energy-ray-curable composition applied in the applying step with a second active energy ray having an illuminance 1.2 times the predetermined illuminance or more.

14. A method for manufacturing printed matter, comprising:

(a) irradiating applied droplets of an active-energy-ray-curable composition with a first active energy ray having an illuminance less than 0.8 times a predetermined illuminance;

(b) irradiating second applied droplets of the active-energy-ray-curable composition with a second active energy ray having an illuminance 0.8 to 1.49 times the predetermined illuminance; and (c) applying additional droplets of the active-energy-ray-curable composition onto the applied droplets irradiated in the steps (a) and (b), wherein the predetermined illuminance is determined by measuring a gloss of each of a plurality of printed matters manufactured using the active-energy-ray-curable composition using a corresponding plurality of active energy ray illuminance values, and selecting one of the active energy ray illuminance values at which the measured gloss was maximum.

15. The method according to claim 14, wherein a ratio of a maximum illuminance of the second active energy ray to a minimum illuminance of the first active energy ray is 1.2 or more.

16. The method according to claim 14, further comprising:

adjusting an output of a light source emitting the first active energy ray to control a 60-degree glossiness of the printed matter within a range in which a difference between a maximum value and a minimum value of the 60-degree glossiness is 20 degrees or more.

17. The method according to claim 16, wherein the printed matter comprises a color image formed of two color inks, each comprising the active-energy-ray-curable composition, wherein a ratio in illuminance of the first active energy ray at which the 60-degree glossiness is maximized for the two color inks is 1.2 or less.

18. The method according to claim 14, further comprising:

measuring a color and a glossiness of an image, wherein the illuminance of the first active energy ray corresponds to the color and the glossiness to reproduce the image.

* * * * *